US005223658A

United States Patent [19]

Suzuki

[11] Patent Number: 5,223,658

[45] Date of Patent: Jun. 29, 1993

[54] ELECTRONIC KEYBOARD INSTRUMENT WITH PAD

[75] Inventor: Satoshi Suzuki, Hamamatsu, Japan

[73] Assignee: Yamaha Corporation, Hamamatsu, Japan

[21] Appl. No.: 468,230

[22] Filed: Jan. 22, 1990

[30] Foreign Application Priority Data

Jan. 25, 1989 [JP] Japan ..... 1-14113

[51] Int. Cl.[5] ..... G10H 5/00; G10H 1/02

[52] U.S. Cl. ..... 84/663; 84/737; 84/738; 84/627; 84/615; 84/653

[58] Field of Search ..... 84/647, 653, 658, 662, 84/663, 665, 670, 723, 730, 737, 738, 741-744, DIG. 12, DIG. 24, 615, 626, 633, 635, 627

[56] References Cited

U.S. PATENT DOCUMENTS 4,018,125 4/1977 Nishimoto ..... 84/658 X
4,418,598 12/1983 Klynas ..... 84/DIG. 12 X
4,481,853 11/1984 Ishikawa ..... 84/DIG. 12 X
4,552,051 11/1985 Takeuchi ..... 84/658 X
4,713,996 12/1987 Oguri ..... 84/DIG. 12 X
4,757,736 7/1988 Tajima et al. ..... 84/DIG. 12 X
4,781,097 11/1988 Uchiyama et al. ..... 84/DIG. 12 X
4,867,028 9/1989 Jones ..... 84/DIG. 12 X
5,001,959 3/1991 Kimpara ..... 84/DIG. 12 X

*Primary Examiner*—William M. Shoop, Jr.
*Assistant Examiner*—Jeffrey W. Donels
*Attorney, Agent, or Firm*—Graham & James

[57] ABSTRACT

An electronic keyboard instrument having a performance pad, a detector, a memory, and a sound system. The detector detects a key touch of a key depressed to assign a percussion tone to the pad. The memory stores the key touch detected by the detector with the percussion tone of the depressed key. The sound system produces the stored percussion tone in accordance with the key touch stored in the memory.

6 Claims, 6 Drawing Sheets

ELECTRONIC KEYBOARD INSTRUMENT WITH PAD

BACKGROUND OF THE INVENTION

1. Field of the Invention

The present invention relates to an electronic keyboard instrument with a pad, which assigns a percussion tone and its touch (velocity) to a performance pad, and produces weak or strong percussion tones.

2. Description of the Prior Art

A conventional electronic keyboard instrument with a pad which has a keyboard and assigns a percussion tone to a performance pad upon depression of a key on the keyboard, and produces the percussion tone assigned in advance when the performance pad is played is known.

However, most inexpensive conventional electronic keyboard instruments with pads comprise no touch sensors in their performance pads. Therefore, these instruments merely assign a percussion tone to a performance pad, and cannot produce the percussion tone with a variable strength.

SUMMARY OF THE INVENTION

The present invention has been made in consideration of the conventional problems, and has as its object to provide an electronic keyboard instrument with a pad, which can produce a percussion tone with a variable strength even if the instrument comprises a performance pad having no touch sensor.

In order to achieve the above object, according to the present invention, there is provided an electronic keyboard instrument having a performance pad to which a percussion tone can be assigned using a keyboard, comprising means for, when a key on the keyboard is depressed, detecting a key touch of the key, means for storing the key touch together with a percussion tone, and means for, when the performance pad is played, producing a corresponding tone with a corresponding touch on the basis of the stored data.

With this arrangement, when a key on the keyboard is depressed to assign a percussion tone to the performance pad, a depression touch can be changed to designate the strength of the percussion tone. Therefore, a weak or strong tone can be assigned, and a percussion tone can be produced with a variable strength.

DETAILED DESCRIPTION OF THE PREFERRED EMBODIMENTS

An embodiment of the present invention will be described below with reference to the accompanying drawings.

Figure 1:
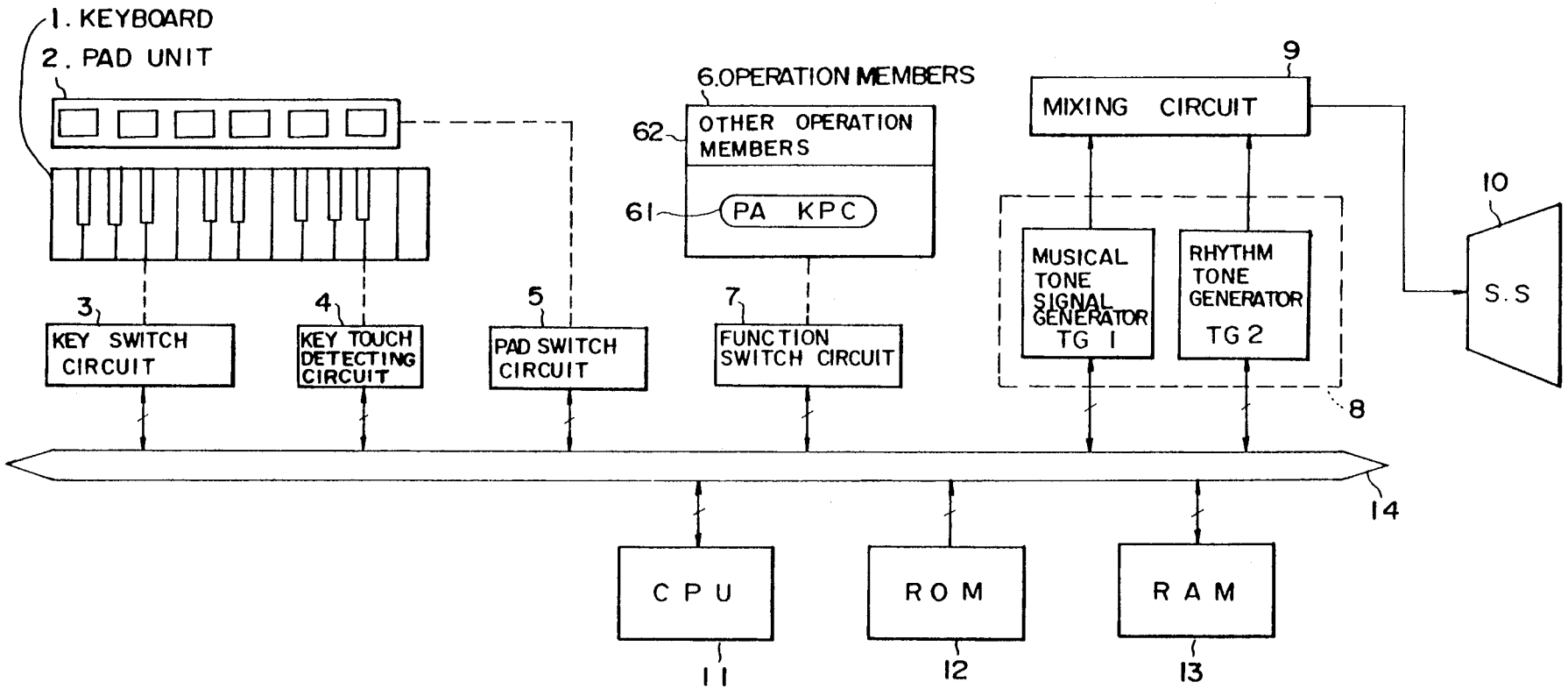
FIG. 1 is a block diagram showing an arrangement of an electronic keyboard instrument with a pad according to an embodiment of the present invention.
Figure 2A:
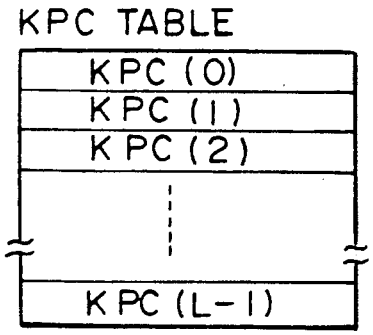
FIGS. 2(*a*) to 2(*d*) show tables in the electronic keyboard instrument of the embodiment shown in FIG. 1.
Figure 2B:
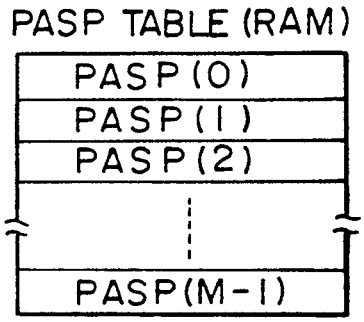
Figure 2C:
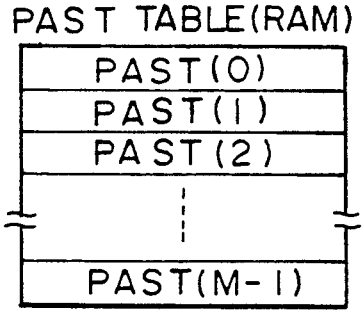
Figure 2D:
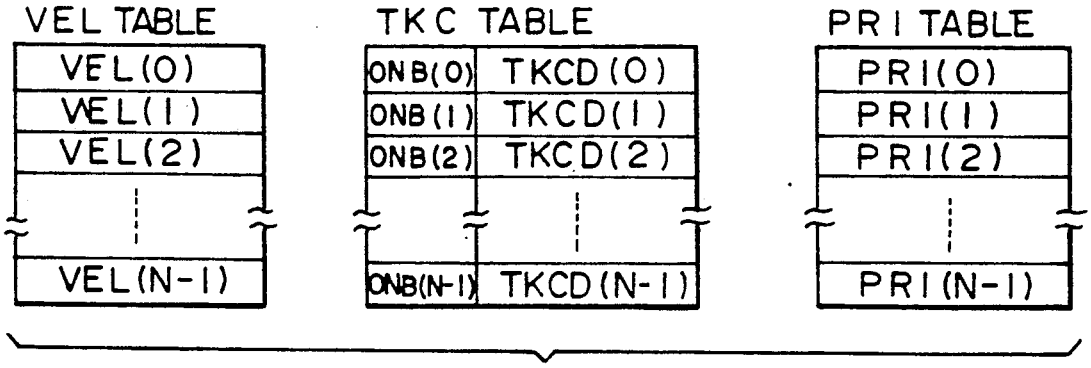

FIG. 1 is a block diagram showing an arrangement of an electronic keyboard instrument with a pad according to the embodiment of the present invention. In FIG. 1, reference numeral 1 denotes a keyboard; 2, a performance pad unit; 3, a key switch circuit for detecting a depression of a key on the keyboard 1; 4, a key touch detecting circuit for detecting a key touch upon depression of the key; and 5, a pad switch circuit for detecting a performance of the performance pad unit 2. Reference numeral 6 denotes operation members for selecting various functions, setting modes, and the like; and 7, a function switch circuit for detecting operations of the operation members 6. The operation members 6 include a PA & KPC switch 61 for selecting whether a normal performance is made (normal performance mode) or a percussion tone is assigned to the pad unit 2 using the keyboard 1 (assign mode), and other operation members 62. Reference numeral 8 denotes a sound source for producing a musical tone signal and a rhythm tone signal; 9, a mixing circuit for mixing musical tone signals from the sound source 8; and 10, a sound system. The sound source 8 comprises a musical tone signal generator TG1 and a rhythm tone generator TG2.

Reference numeral 11 denotes a CPU for controlling the operation of the electronic keyboard instrument of this embodiment; 12, a ROM for storing control programs, and the like; 13, a RAM for temporarily storing various data as a working memory; and 14, a bus line.

The RAM 13 is allocated with the following flags, registers, and tables.

(a) PGM: Performance/Assign Flag

When this flag is "0", it indicates the normal performance mode, and a percussion tone is produced upon operation of the performance pad. When this flag is "1", it indicates the assign mode for assigning a percussion tone from the keyboard to the performance pad.

(b) KON: Key ON Flag

When one of keys on the keyboard is depressed, this flag becomes "1"; when none of keys is depressed, this flag becomes "0".

PON: Pad ON Flag

When the number of pads of the performance pad unit is represented by M, this flag consists of a string of M elements, i.e., PON(0) to PON(M−1). If i is a pad number for specifying a pad, when PON(i) is "1", it indicates that the corresponding pad is ON; when it is "0", it indicates that the corresponding pad is OFF.

(d) KCD: Key Code Register

This register stores a key code of a depressed keyboard key.

(e) TD: Touch Data Register

This register stores key touch data (velocity data) upon depression of a keyboard key.

(f) PCN: Percussion Number Register

This register stores a percussion number for specifying a percussion tone to be produced.

(g) KPC: Table (FIG. 2(*a*))

This table is used to obtain a corresponding percussion number on the basis of a key code. The table consists of L elements, i.e., KPC(0) to KPC(L−1). A percussion number corresponding to the key code i can be accessed by KPC(i).

(h) PASP: Table (FIG. 2(*b*))

This table stores percussion numbers of percussion tones assigned to the corresponding percussion pads. The table consists of M elements, i.e., PASP(0) to PASP(M−1) (M is the number of pads). A percussion number assigned to a pad of the pad number i can be accessed by PASP(i).

(i) PAST: Table (FIG. 2(*c*))

This table stores touch data of percussion tones assigned to the corresponding performance pads. The table consists of M elements, i.e., PAST(0) to PAST(M-1) (M is the number of pads). Touch data assigned to a pad of the pad number i can be accessed by PAST(i).

(j) Others:

A VEL table, TKC table, and PRI table (FIG. 2(*d*)) are used in processing when a plurality of keyboard keys are depressed in the assign mode of percussion tones.

The operation of the electronic keyboard instrument with the pad shown in FIG. 1 will be described below with reference to the flow charts of FIGS. 3 to 8.

Figure 3:
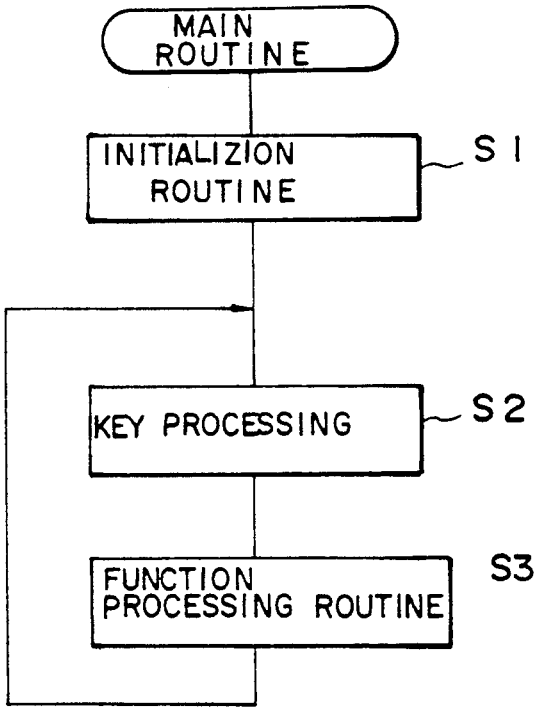
FIG. 3 is a flow chart of a main routine showing an operation of the electronic keyboard instrument of the embodiment shown in FIG. 1.

Referring to FIG. 3, the electronic keyboard instrument with the pad initializes the flags and registers in step S1 after the operation is started. Key processing in step S2 and function switch processing in step S3 are then repeated. In the key processing in step S2, it is checked if an ON or OFF event of the keyboard 1 or the performance pad unit 2 is present by the key switch circuit 3 or the pad switch circuit 5 in FIG. 1. If an event is detected, the corresponding one of processing routines shown in FIGS. 5 to 8 is called. In the function switch processing shown in step S3, the presence/absence of an operation of the operation members 6 is checked by the function switch circuit 7 in FIG. 1. If any operation is detected, a processing routine corresponding to the operation is called.

Figure 4:
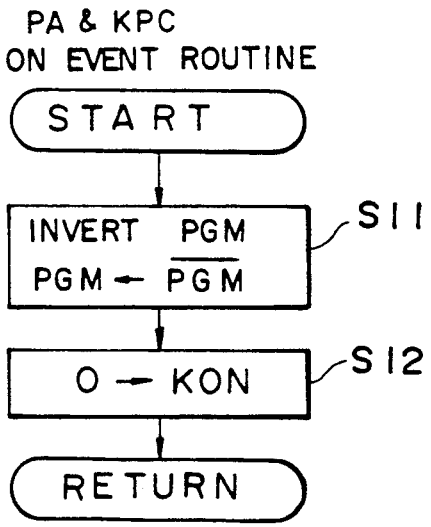
FIG. 4 is a flow chart of a PA & KPC ON event routine.

In particular, when the PA & KPC switch 61 as an operation member for switching the normal performance mode and the assign mode for assigning a percussion tone to the performance pad is depressed, the PA & KPC ON event routine shown in FIG. 4 is executed.

Referring to FIG. 4, when the PA & KPC switch is turned on, the PGM flag is inverted in step S11. More specifically, when the current mode is the normal performance mode (PGM="0"), the percussion tone assign mode is set (PGM="1"); otherwise, the normal performance mode is set. In step S12, the KON flag is cleared to "0", and the flow then returns to the main routine. In this routine, only the flags are processed, and even if a tone is being produced at that time, no key OFF signal is sent to the sound source 8.

Figure 5:
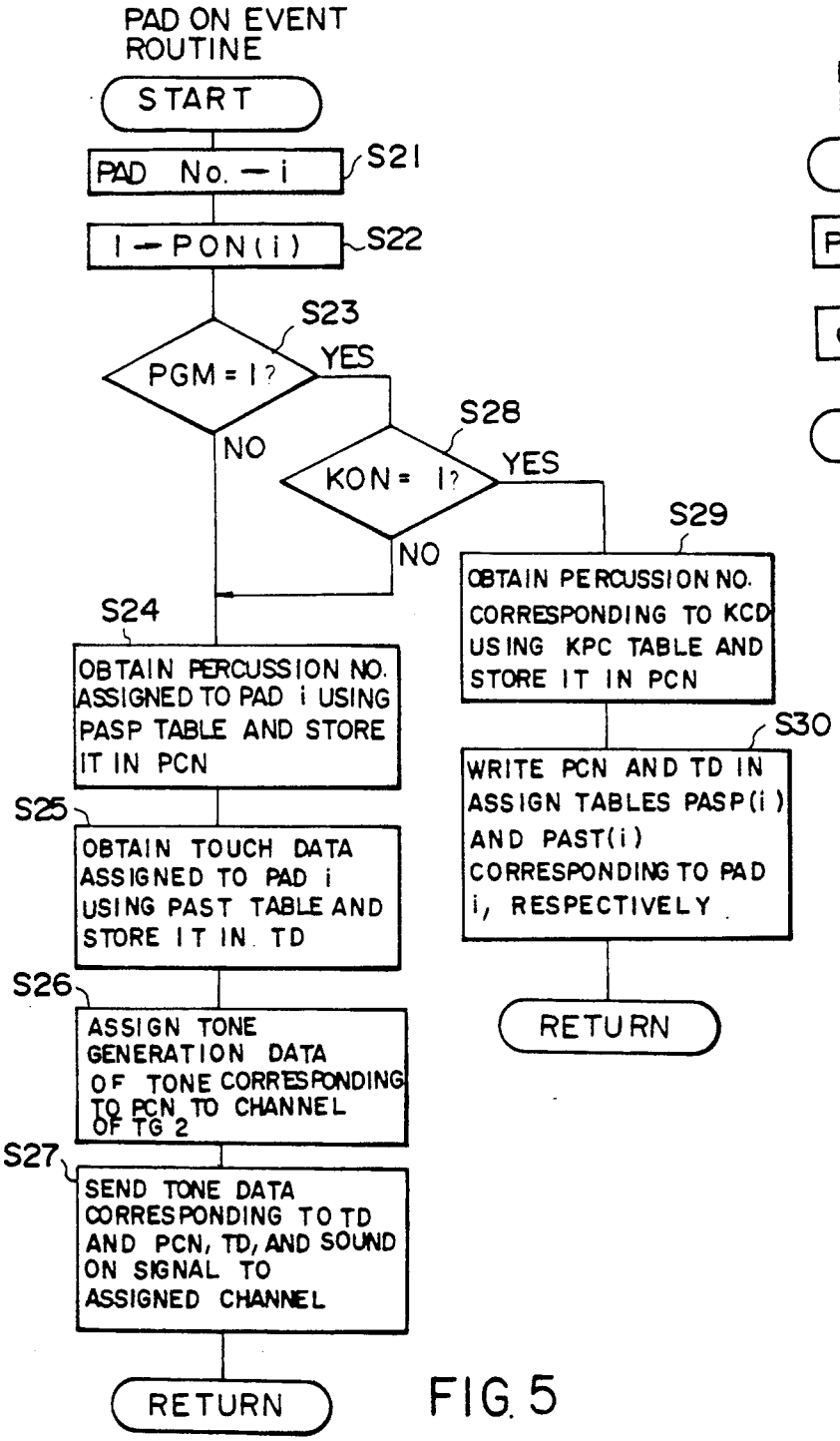
FIG. 5 is a flow chart of a pad ON event routine.

If it is determined in the key processing in step S2 in FIG. 3 that an ON event of the performance pad is detected, the pad ON event routine shown in FIG. 5 is called.

Referring to FIG. 5, in the pad ON event routine, the pad number of the ON pad is stored in a working register i in step S21. In step S22, "1"is set in the pad ON flag PON(i).

In step S23, the PGM flag is checked. If the PGM flag is not "1", since the normal performance mode is selected, percussion tone generation processing in steps S24 to S27 is executed. More specifically, in step S24, the percussion number assigned to the pad of the pad number i is obtained using the PASP table and is stored in the percussion number register PCN. In step S25, touch data (velocity data) assigned to the pad of the pad number i is obtained using the PAST table, and is stored in the touch data register TD. In step S26, tone generation data of a percussion tone corresponding to the percussion number PCN is assigned to a channel of the rhythm tone generator TG2. In step S27, tone data corresponding to the touch data TD and the percussion number PCN, the touch data TD itself, and a sound ON signal are sent to the assigned channel, and the flow returns to the main routine. Thus, the assigned percussion tone can be produced with the assigned touch. If it is determined in step S23 that the PGM flag is "1", i.e., the percussion tone assign mode is selected, the KON flag is checked in step S28. If the KON flag is not "1", the flow branches to step S24. Since this flag means that an operation for S24. Since this flag means that an operation for producing a percussion tone to be assigned upon depression of a keyboard key has not been performed yet, percussion tone generation processing from step S24 is executed.

If it is determined in step S28 that the KON flag is "1", since this flag means that the keyboard key has already been depressed, a player has already confirmed a percussion tone to be assigned in the key ON event routine (to be described later), and the depressed key code and touch data are respectively stored in the registers KCD and TD, the flow branches to step S29, and write access to the assign table is executed. More specifically, in step S29, a percussion number corresponding to the key code KCD of the depressed key is obtained using the KPC table, and is stored in the register PCN. In step S30, the percussion number PCN is written in the element PASP(i) of the assign table corresponding to the pad number i, and the touch data TD is written in the element PAST(i). The flow then returns to the main routine. Thus, the percussion tone and touch data are assigned to the designated pad.

Figure 6:
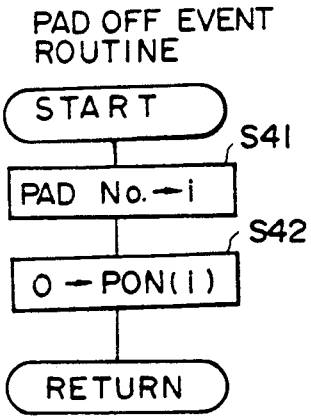
FIG. 6 is a flow chart of a pad OFF event routine.

If it is determined in the key processing in step S2 in FIG. 3 that an OFF event of the performance pad 2 is detected, the pad OFF event routine shown in FIG. 6 is called.

Referring to FIG. 6, in the pad OFF event routine, the pad number of the OFF pad is stored in the working register i in step S41. In step S42, the pad ON flag PON(i) is cleared to zero, and the flow returns to the main routine.

Figure 7:
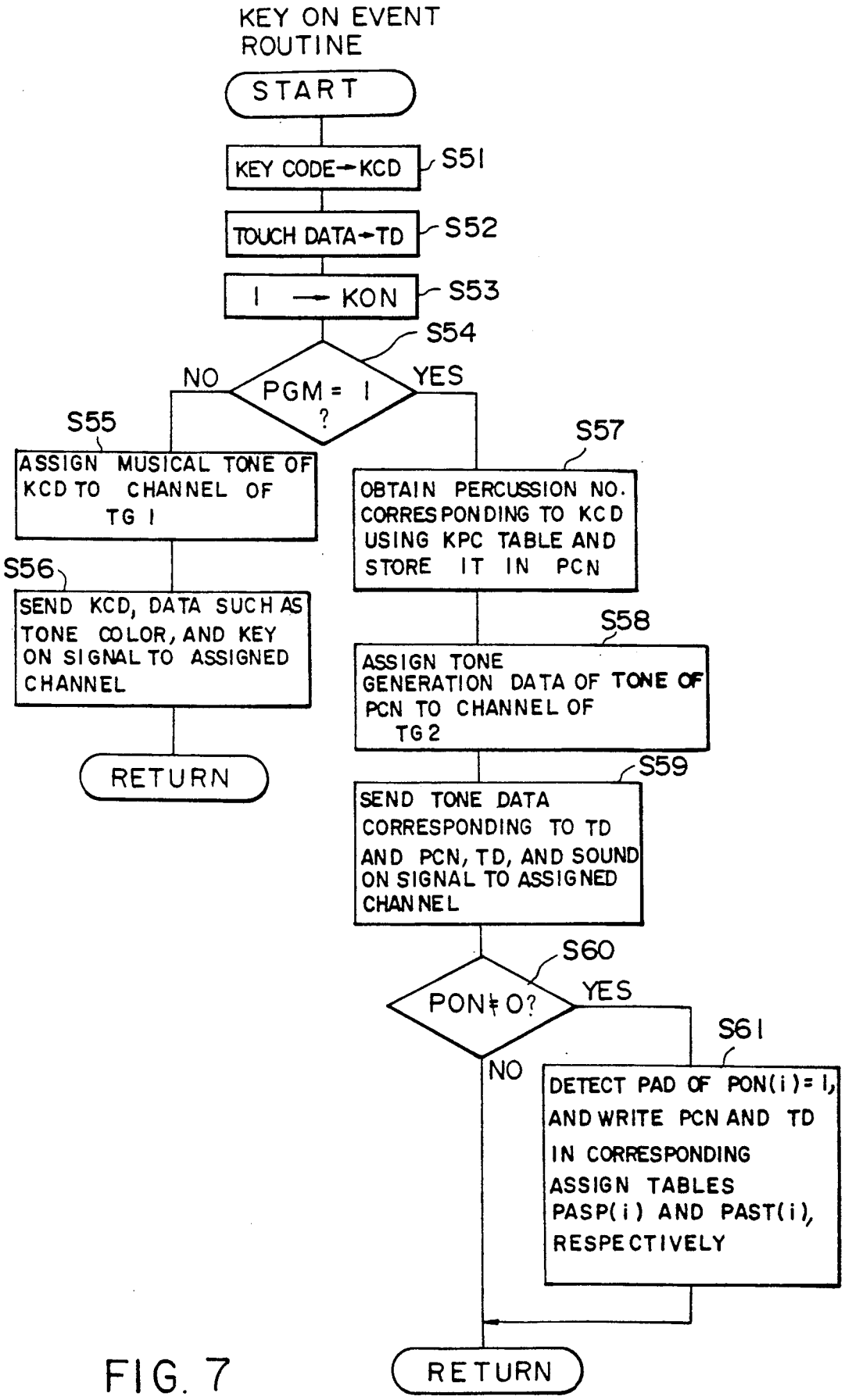
FIG. 7 is a flow chart of a key ON event routine.

If it is determined in the key processing in step S2 in FIG. 3 that an ON event of a key on the keyboard 1 is detected, the key ON event routine shown in FIG. 7 is called.

Referring to FIG. 7, in the key ON event routine, the key code of the 0 keyboard key is stored in the register KCD in step S51. In step S52, touch data upon depression of the corresponding keyboard key is stored in the register TD. The touch data is detected by the key touch sensor 4. In step S53, "1"is set in the KON flag. In step S54, the PGM flag is checked. If the PGM flag is not "1", since the normal performance mode is selected, the sequence branches to step S55. In step S55, a musical tone of the key code KCD is assigned to a channel of the musical tone signal generator TG1. In step S56, the key code KCD, data such as tone color data, and a key ON signal are sent to the assigned channel, and the flow then returns to the main routine. Thus, tone generation upon depression of a keyboard key can be normally executed.

If it is determined in step S54 that the PGM flag is "1", since the assign mode of the percussion tone is selected, a percussion number corresponding to the key code KCD of the depressed key is obtained using the KPC table, and is stored in the register PCN in step S57. In step S58, tone generation data of a percussion tone corresponding to the percussion number PCN is assigned to a channel of the rhythm tone generator TG2. In step S59, tone data corresponding to the touch data TD and the percussion number PCN, the touch data TD itself, and a sound ON signal are sent to the assigned channel, and the flow then returns. In this manner, a percussion tone to be assigned can be produced upon depression of the corresponding keyboard key, and a player can confirm it.

In step S60, the PON flag is checked. When PON flags PON(0) to PON(M−1) are all "0"s, this means that a pad to be assigned has not been set ON yet. Therefore, the flow returns to the main routine without any processing. If one of the PON flags is not "0", this means that a pad to be assigned is set ON before this key ON event. Therefore, i which satisfies PON(i) =1 is detected in step S61, and the percussion number PCN is written in the assign table PASP(i) corresponding to the pad number i, and the touch data TD is written in the table PAST(i). The flow then returns to the main routine. In this embodiment, a percussion tone is assigned to a pad upon both the pad ON event and the key ON event, so that assignment to the pad can be reliably performed, and operability can be improved.

Figure 8:
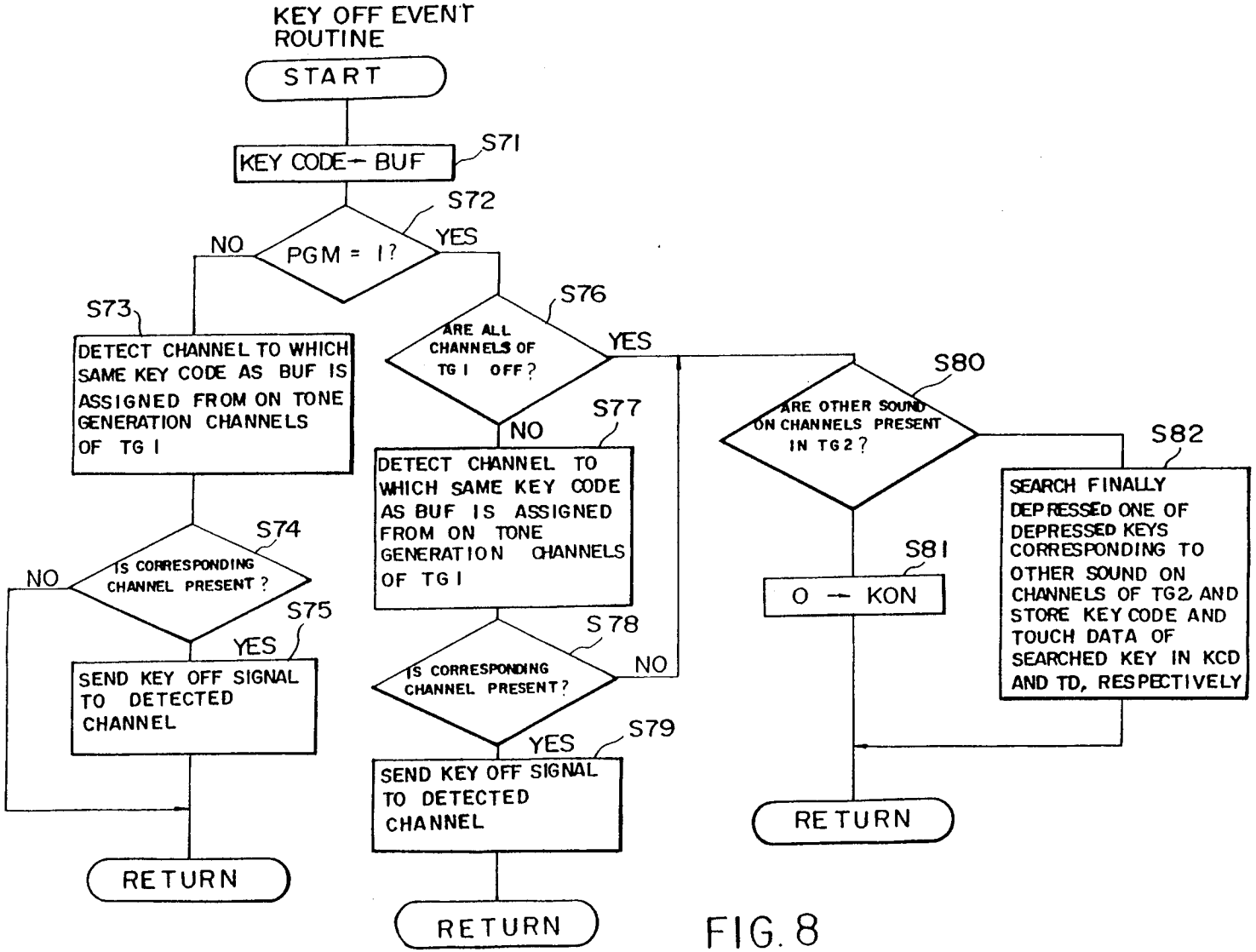
FIG. 8 is a flow chart of a key OFF event routine.

If it is determined in the key processing in step S2 in FIG. 3 that an OFF event of a key on the keyboard 1 is detected, the key OFF event routine shown in FIG. 8 is called.

Referring to FIG. 8, the key code corresponding to the key OFF event is stored in a work register BUF in step S71. In step S72, the PGM flag is checked. If the PGM flag is not "1", since the normal performance mode is selected, a channel to which the same key code as in the work register BUF is assigned is detected from the ON tone generation channels of the tone generator TG1 in step S73. If the corresponding channel is detected in step S74, a key OFF signal is sent to the channel in step S75. The flow then returns to the main routine. In this manner, muting processing in the normal performance mode is executed.

If it is determined in step S72 that the PGM flag is "1", since the percussion tone assign mode is selected, it is checked in step S76 if all the channels of the tone generator TG1 are set OFF. If NO in step S76, a channel to which the same key code as in the work register BUF is assigned is detected from the ON tone generation channels of the tone generator TG1 in step S77. If the corresponding channel is detected in step S78, a key OFF signal is sent to the channel in step S79.

If it is determined in step S76 that all the channels of the tone generator TG1 are set OFF, or if no corresponding channel of the tone generator TG1 is detected in step S78, since muting processing of the percussion tone should be performed, it is checked in step S80 if the tone generator TG2 has other sound ON channels. If NO in step S80, the KON flag is cleared to "0"in step S81, and the flow returns to the main routine; otherwise, the finally depressed one of depressed keys corresponding t the other sound ON channels of the tone generator TG2 is searched in step S82. The key code of the searched key is stored in the register KCD, and its touch data is stored in the register TD. The flow then returns to the main routine. This processing is performed for the following reason. When a plurality of keys are depressed, the finally depressed key is assigned to a pad. However, if an ON key remains after the OFF event of the assigned key is detected, the ON key is assigned upon the pad ON event.

In order to detect the final ON key when a plurality of keys are depressed like in step S82, a table shown in FIG. 2(*d*) can be used. In FIG. 2(*d*), the VEL table consists of N elements corresponding to the tone generation channels of the tone generator TG2 (the number of channels is N), and stores touch data of a percussion tone of the corresponding channel. The TKC table consists of N elements corresponding to the tone generation channels of the tone generator TG2. In this table, ONB(i) is a bit indicating an ON/OFF state of an ith channel, and TKCD(i) is an area for storing the key code of the ith channel. The PRI table consists of PRI(i) for counting a priority corresponding to the ith channel. When ONB(i) is "1", PRI(i) is incremented by one in response to a new key ON event. Thus, a key having the smallest priority value can be determined as a latest depressed key.

With the above-mentioned sequence, in this embodiment, a pad to be assigned in the assign mode is set ON and is then set OFF, and thereafter, a keyboard key is depressed with a desired touch to confirm a percussion tone and touch to be assigned (by actually generating it). Thus, data are stored in the assign tables PASP and PAST. When the corresponding pad is played in the normal performance mode, a predetermined percussion tone can be produced with the stored touch.

As described above, according to the present invention, in an electronic musical instrument having a performance pad to which a percussion tone can be assigned, touch data can be assigned in addition to an instrument number of a percussion. Therefore, weak and strong percussion tones can be produced, thus allowing expression of variable tone strength.

What is claimed is:

1. An electronic instrument comprising:
a performance pad to be played by a player;
performance elements, each corresponding to a percussion tone, to be played by a player;
detection means for, when a performance element is played, detecting the played performance element and the play touch representing a strength in playing the performance element;
assigning means for assigning to the performance pad the percussion tone and the play touch corresponding to the played performance element detected by said detecting means; and
means for, when said performance pad is played, producing the assigned percussion tone in accordance with the assigned play touch.

2. An electronic instrument according to claim 1, wherein the performance elements are the keys of a keyboard.

3. An electronic instrument according to claim 1, wherein the assigning means assigns to the performance pad the percussion tone and the play touch corresponding to the played performance element when the performance pad is played simultaneously with playing of the performance element.

4. An electronic instrument according to claim 1, wherein the instrument is incapable of detecting a strength playing on the performance pad based on the play touch of the player.

5. An electronic instrument comprising:
a performance pad to be played by a player;
performance elements, each corresponding to a percussion tone, to be played by a player;

detection means for, when a performance element is played, detecting the played performance element and the play touch representing a strength on playing the performance element;

storage means for storing first data designating the percussion tone corresponding to the played performance element and second data designating the play touch corresponding to the played performance element; and means for, when said performance pad is played, producing the percussion tone signal disignated with the first data in accordance with the play touch designated with the second data.

6. An electronic instrument according to claim 5, wherein the performance elements are the keys of a keyboard.

* * * * *